US009138750B2

(12) United States Patent
Swanda et al.

(10) Patent No.: US 9,138,750 B2
(45) Date of Patent: Sep. 22, 2015

(54) SPRAY APPARATUS AND METHOD FOR SEPARATING PLANT EMBRYOS

(71) Applicant: WEYERHAEUSER NR COMPANY, Federal Way, WA (US)

(72) Inventors: Anthony P. Swanda, Snoqualmie, WA (US); Robert A. Starr, Auburn, WA (US); Henry M. Givens, Tacoma, WA (US)

(73) Assignee: Weyerhaeuser NR Company, Federal Way, WA (US)

( * ) Notice: Subject to any disclaimer, the term of this patent is extended or adjusted under 35 U.S.C. 154(b) by 291 days.

(21) Appl. No.: 13/718,932

(22) Filed: Dec. 18, 2012

(65) Prior Publication Data

US 2013/0168296 A1 Jul. 4, 2013

Related U.S. Application Data

(60) Provisional application No. 61/581,447, filed on Dec. 29, 2011.

(51) Int. Cl.

| | |
|---|---|
| ***B03B 5/68*** | (2006.01) |
| ***B03B 5/00*** | (2006.01) |
| ***B05B 15/06*** | (2006.01) |
| ***B05B 1/20*** | (2006.01) |
| ***B05B 13/04*** | (2006.01) |
| *B05B 1/04* | (2006.01) |
| *B05B 1/06* | (2006.01) |

(52) U.S. Cl.
CPC . *B03B 5/00* (2013.01); *B05B 1/202* (2013.01); *B05B 13/0421* (2013.01); *B05B 15/069* (2013.01); *B05B 1/04* (2013.01); *B05B 1/06* (2013.01)

(58) Field of Classification Search
CPC ..... B03B 5/00; B03B 5/68; B03B 5/70; C12N 5/04; A01H 4/005
USPC ..... 209/262, 268, 932; 435/422, 430.1
See application file for complete search history.

(56) References Cited

U.S. PATENT DOCUMENTS

| | | | | |
|---|---|---|---|---|
| 2,874,840 | A * | 2/1959 | Simpson | 209/250 |
| 5,124,029 | A * | 6/1992 | Fjallstrom et al. | 209/250 |
| 7,560,611 | B2 * | 7/2009 | Adams et al. | 800/278 |
| 7,685,767 | B2 * | 3/2010 | Timmis et al. | 47/57.6 |
| 8,925,245 | B2 * | 1/2015 | Brownell et al. | 47/58.1 R |
| 8,931,208 | B2 * | 1/2015 | Swanda et al. | 47/57.6 |
| 2008/0015790 | A1 * | 1/2008 | Timmis et al. | 702/19 |
| 2008/0256667 | A1 * | 10/2008 | Dersch et al. | 800/294 |
| 2013/0008834 | A1 * | 1/2013 | Trussell et al. | 209/380 |
| 2014/0004606 | A1 * | 1/2014 | Jamruszka-Lewis et al. | 435/422 |
| 2014/0186956 | A1 * | 7/2014 | Cootsona | 435/422 |
| 2015/0007370 | A1 * | 1/2015 | Adams et al. | 800/320.1 |

* cited by examiner

*Primary Examiner* — Joseph C Rodriguez
(74) *Attorney, Agent, or Firm* — Baker Hostetler LLP

(57) ABSTRACT

The present invention is directed to a spray apparatus and methods for the separation of plant embryos.

6 Claims, 4 Drawing Sheets

SPRAY APPARATUS AND METHOD FOR SEPARATING PLANT EMBRYOS

CROSS-REFERENCE TO RELATED APPLICATION

This application is entitled to and claims the benefit of priority under 35 U.S.C. §119 from U.S. Provisional Patent Application Ser. No. 61/581,447 filed Dec. 29, 2011, and titled "SPRAY APPARATUS AND METHODS FOR SEPARATING PLANT EMBRYOS," the contents of which are incorporated herein by reference

BACKGROUND

Modern silviculture often requires the planting of large numbers of genetically identical plants that have been selected to have advantageous properties. Production of new plants by sexual reproduction, which yields botanic seeds, is usually not feasible. Asexual propagation, via the culturing of somatic or zygotic embryos, has been shown for some species to yield large numbers of genetically identical embryos, each having the capacity to develop into a normal plant.

Somatic cloning is the process of creating genetically identical plants from plant tissue other than male and female gametes. In one approach to somatic cloning, plant tissue is cultured in an initiation medium that includes hormones, such as auxins and/or cytokinins, to initiate formation of embryogenic tissue, such as embryogenic suspensor masses, that are capable of developing into somatic embryos. The embryogenic tissue is then further cultured in a multiplication medium that promotes multiplication and mass production of the embryogenic tissue. The embryogenic tissue is then cultured in a development medium that promotes development and maturation of cotyledonary somatic embryos that may, for example, be placed on germination medium to produce germinants, and subsequently transferred to soil for further growth, or alternatively, placed within manufactured seeds and sown in soil where they germinate to yield seedlings. Manufactured seeds are described, for example, in U.S. Pat. Nos. 5,564,224; 5,687,504; 5,701,699; and 6,119,395.

The somatic embryogenesis process typically is laborious and inefficient. For example, a labor intensive step in the embryogenesis process is the selective harvesting from development medium of individual embryos suitable for germination.

Efforts have been made to automate the harvesting of cotyledonary embryos. One of the steps in the harvesting process is known as separation. At the end of the development phase, the embryos may be present in a number of stages of maturity and development, and are typically attached to or imbedded in embryogenic suspensor mass. Separation is a processing step that occurs at the end of development and maturation in which plant embryos are physically separated from each other and the underlying embryogenic suspensor mass (ESM) before further processing such as, for example, insertion into manufactured seed, or placement onto germination or pre-germination medium for further treatment prior to insertion into manufactured seed. Separation may be accomplished by spraying the embryos and attached ESM with liquid to remove the embryos from the development medium and using a series of sieves to separate the embryos from each other and residual ESM.

The present invention is directed to a spray apparatus and methods for separating plant embryos

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

In one aspect, the present invention is directed to a spray apparatus to facilitate the separation of plant embryos. A spray apparatus of the present invention for separating plant embryos includes: (a) a spray bar; (b) a combination of spray nozzles mounted on the spray bar, wherein each of the spray nozzles comprises: (i) a body having a discharge orifice at a downstream end and an inlet at an upstream end for connection to a liquid supply, and (ii) a first liquid passageway extending through the body from the inlet to the discharge orifice; (c) a second liquid passageway extending through the interior of the spray bar, wherein the second liquid passageway is in fluid flow communication with the first liquid passageway for communicating liquid from a liquid supply to the discharge orifices of the spray nozzles for discharge from the nozzles as liquid sprays; (d) wherein the spray nozzles are positioned along the spray bar and extend outwardly from the spray bar to direct the liquid sprays toward a porous substrate upon which a plurality of plant embryos are disposed; and (e) wherein the spray nozzles are configured to discharge spray patterns designed to push the plant embryos through the porous substrate and also move the embryos across the surface of the porous substrate.

In one aspect the present invention is directed to methods of separating plant embryos.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

Figure 1:
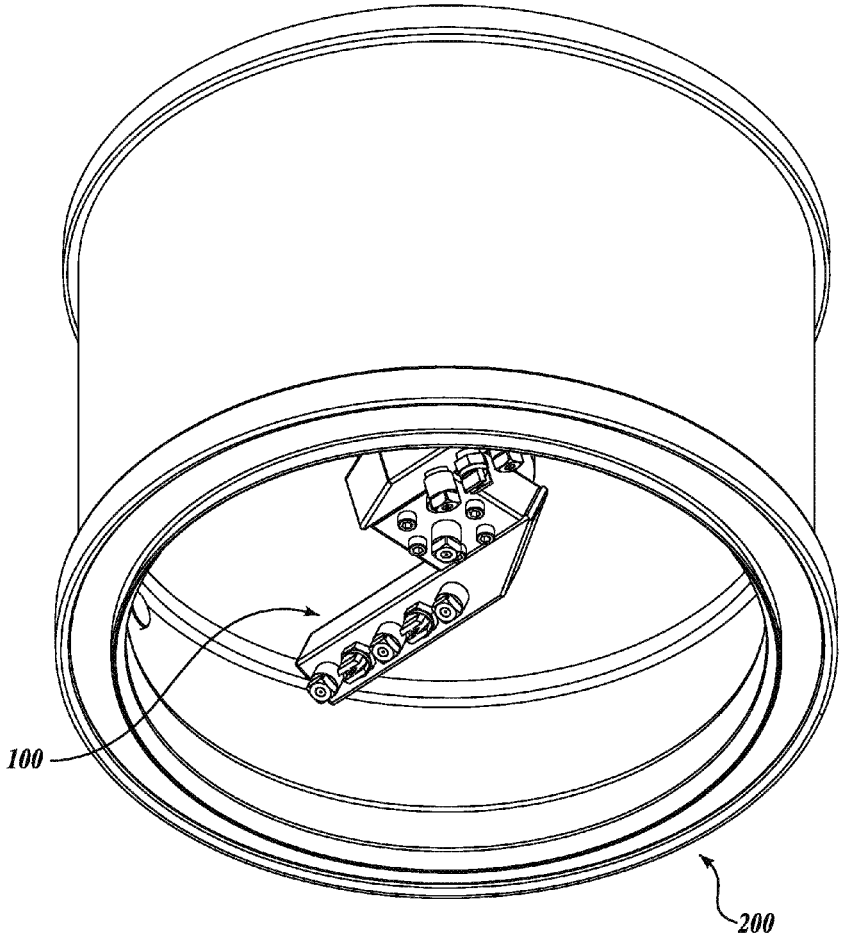
FIG. 1 illustrates a bottom perspective view of an embodiment of the spray apparatus of the invention mounted in a housing.

As used herein, the term "embryogenic suspensor mass" (ESM) refers to early stage embryos in the process of multiplication by budding and cleavage.

As used herein, the term "embryogenic tissue" refers to an aggregate of tens to hundreds of embryogenic cells that form an embryogenic suspensor mass.

As used herein, the term "plant embryo" refers to a somatic plant embryo. Somatic plant embryos may be produced by culturing embryogenic tissue by standard methods under laboratory conditions in which the cells comprising the tissue are separated from one another and urged to develop into minute complete embryos. As used herein, "plant embryo" includes embryos at various stages of development.

As used herein, the term "cotyledonary embryo" refers to an embryo that possesses one or more cotyledons. Cotyledonary embryos have a well defined elongated bipolar structure with latent meristem with cotyledonary primordia at one end and a potential radicle at the opposite end. The cotyledonary structure frequently appears as a small "crown" at one end of the embryo.

As used herein, the term "separate" or "separation" refers to the process of separating cotyledonary embryos from attached embryogenic suspensor mass and from each other.

The somatic embryogenesis process is a process to develop plant embryos in vitro. Methods for producing plant somatic embryos are known in the art and have been previously described (see, e.g., U.S. Pat. Nos. 4,957,866; 5,034,326; 5,036,007; 5,041,382; 5,236,841; 5,294,549; 5,482,857; 5,563,061; and 5,821,126). Generally, the somatic embryogenesis process includes the steps of (1) initiation or induction, to initiate formation of embryogenic tissue, such as embryogenic suspensor mass (ESM), which is a white mucilaginous mass that includes early stage embryos having a long, thin-walled suspensor associated with a small head with dense cytoplasm and large nuclei; (2) multiplication, sometimes referred to as maintenance, to multiply and mass produce embryogenic tissue; (3) development, to develop and form mature cotyledonary somatic embryos; and (4) post development steps such as separation, singulation, stratification, germination, placement into manufactured seeds, and transferring to soil for further growth and development.

The somatic embryogenesis process is labor intensive. Efforts have been made to automate and scale-up the process to facilitate the production of plant embryos in large scale, perhaps tens of thousands at a time. For example, the multiplication step may be carried out in a commercial-scale liquid bioreactor. At the end of the multiplication step, embryogenic tissue may be transferred to development medium for a period of time to develop into cotyledonary embryos. At the end of the development period, the cotyledonary embryos are to various degrees attached to and embedded in suspensor tissues and residual underdeveloped ESM, together with incompletely developed embryos, abnormally formed embryos, undersized or oversized embryos, and other pieces of non-embryo plant material, and to other embryos. It is important for subsequent normal germination to separate the embryos from the suspensor mass and from other embryos to yield individual embryos.

Automating the separation step is important for commercial scale-up of the embryogenesis process, as well as for productivity and worker well-being. During automated separation, the embryos may be washed off from a development medium using aqueous liquid, such as water or an isotonic nutrient solution, and passed through a series of sieves to sort the embryos into different sizes. During sieving, the embryos may be further sprayed with aqueous liquid to facilitate removal and washing away of any undesirable material, such as undersized embryos, tissues, and residual embryogenic suspensor masses.

In one aspect, the present invention is directed to a spray apparatus to facilitate the separation of plant embryos. A spray apparatus shown in accordance with one embodiment of the present invention is best seen by referring to FIGS. 1-6. A spray apparatus of the present invention for separating plant embryos includes: (a) a hollow spray bar 100 connected to a liquid supply; and (b) a combination of spray nozzles 10 and 15 mounted on the spray bar 100 and in fluid flow communication with the spray bar to discharge liquid in a plurality of spray patterns.

The spray bar 100 services as a conduit, regardless of shape, configured to deliver a liquid to the nozzles mounted on the spray bar 100. By way of example, the spray bar 100 may be generally cylindrical, rectangular, square or of other tubular cross-sectional shape. The shape of the spray bar 100 may be uniform throughout the spray bar 100, may taper to or from one end, may taper to or from both ends, or may be of non-uniform variable dimension. The spray bar 100 may be straight, or include bends or curves. The spray bar 100 may be made of stainless steel, other metal, composite, alloy, or any other suitable material known in the art.

The spray bar 100 may be mounted in a housing 200 to rotate around an axis 102. The spray apparatus further comprises a drive system, not shown, to rotate the spray bar 100 about the rotational axis 102 of the spray bar 100.

Figures 2, 3:
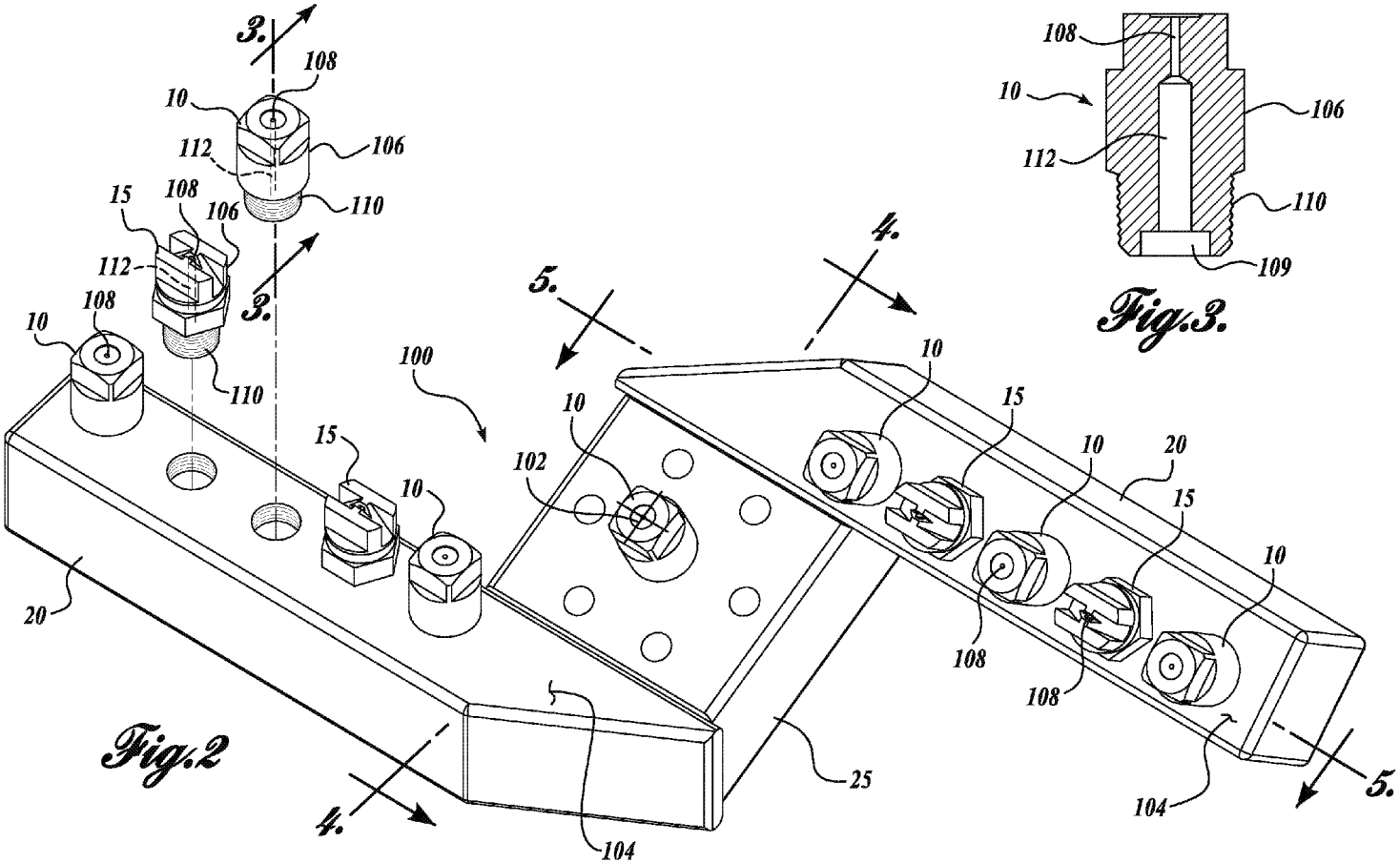
FIG. 2 illustrates an isometric view of the underside of the spray apparatus of the invention.
FIG. 3 illustrates a cross-sectional view of a spray nozzle of the spray apparatus shown in FIG. 2.

The spray apparatus may be configured with at least one spray bar, in many alternate ways. For example the spray apparatus may include a single spray bar 100, or the spray bar 100 may comprise a plurality of arms 20 extending outwardly from a rotational axis 102 of the spray bar 100, as shown in FIG. 2. The spray bar 100 may have, for example, a single arm 20, two arms 20, or four arms 20. In one embodiment shown in FIG. 2, the spray bar comprises two arms 20. In another embodiment (not shown), the spray bar comprises four arms 20. In some embodiments, the arms of the spray bar 100 are generally of rectilinear shape. Also, the arms 20 of the spray bar may extend outwardly in opposite directions from the rotational axis 102.

The spray bar 100 may include at least one liquid inlet (not shown) configured to receive a liquid from a supply source. The supply source may be configured to deliver any liquid suitable for separating embryos, such as, for example, water or isotonic solution.

The spray bar 100 may include a plurality of spray nozzles 10 and 15. The spray nozzles may simply be perforations in the wall of the spray bar 100. In another embodiment, each arm 20 of the spray bar 100 comprises a nozzle mounting surface 104 upon which the spray nozzles 10 and 15 are mounted to direct liquid toward a substrate on which a plurality of plant embryos are disposed.

The nozzles may have a structure comprising a body 106 having a discharge orifice 108 at a downstream end and an inlet 109 at an upstream end for connection to the interior of arm 20. A liquid passageway 112 extends through the body from the inlet to the discharge orifice. The discharge orifice is of a configuration such that the liquid discharged from the discharge orifice 108 is in the form of a pattern. The nozzles also include a threaded shank 110 for screwing the nozzles 10 and 15 to the threaded openings 118 formed in mounting surface 104.

In one embodiment, the spray nozzles are selected from the group consisting of nozzles that discharge a cone shaped-spray pattern, a fan-shaped spray pattern, an oval-shaped spray pattern, and combinations thereof. The configuration of the discharge orifices of the spray nozzles 10 shown in the figures is such that the liquid discharged from the discharge orifices is in the form of a cone-shaped spray pattern. In addition, the configuration of the discharge orifices of the spray nozzles 15 is such that the liquid discharged from the discharge orifices is in the form a fan-shaped pattern. In one embodiment, a combination of spray nozzles 10 and 15 may be used. In one embodiment, only nozzles 10 that discharge liquid in a cone-shaped pattern may be used. In one embodiment, only nozzles 15 that discharge liquid in a fan-shaped pattern may be used. Of course, other spray patterns may be used, for example an oval-shaped spray pattern.

As shown in the figures, the spray nozzles 10 and 15 are arranged on the spray bar 100 such that the spray nozzles 10 that discharge a cone-shaped spray pattern are alternated with the spray nozzles 15 that discharge a fan-shaped spray pattern.

The spray bar 100, shown in the figures, further comprises a central hub 25, and a plurality of arms 20, wherein the arms 20 extend from opposite sides of the hub as shown in FIG. 2. The arms 20 extend outwardly from the central hub 25 in opposite directions in spaced lateral relationship to each other. Spray nozzles 10 and 15 are positioned on mounting surface 104 along the arms 20. The shape of the central hub 25 may vary. In the figures, the hub is shown as substantially square in shape, but it may be rectangular, round or of other shapes. Also, the number of arms 20, the length of each arm 20, and the number of spray nozzles 10 and 15 mounted on each arm may vary, depending on various factors, for example, on the size of the substrate upon which plant embryos are disposed.

In the embodiment shown in FIG. 2, the spray bar 100 comprises two arms 20 extending outwardly in opposite directions from a central hub 25. A spray nozzle 10 is mounted on the central hub to discharge a cone-shaped spray pattern. Three spray nozzles 10 are shown as mounted on each arm 20, which discharge a cone-shaped spray pattern, alternated with two spray nozzles 15, also mounted on each arm 20, which discharge a fan-shaped spray pattern. In the embodiment of FIG. 2, the nozzles are positioned on each arm such that the spray nozzle 10 nearest the central hub 25 discharges a cone-shaped spray pattern.

The spray nozzles 10 and 15 may be evenly spaced along each arm 20 of the spray bar 100. Alternatively, the spacing between the spray nozzles 10 and 15 may vary depending on the length of the arms 20 of the spray bar 100, the number of spray nozzles 10 and 15, and the size of the substrate upon which plant embryos are disposed. For example, the spacing between the spray nozzles 10 and 15 toward or proximal to the hub 25 may be greater than the spacing between the spray nozzles 10 and 15 toward the distal ends of the arms 20 to balance the amount of liquid applied by the spray jets on the substrate between the center and outer edges of the substrate upon which the embryos are disposed.

Figure 4:
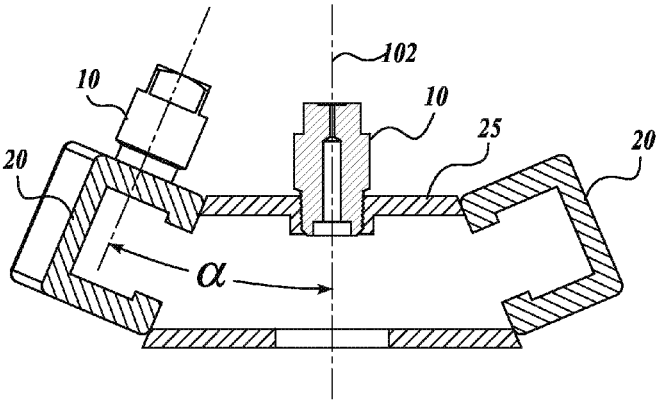
FIG. 4 illustrates a cross-sectional view of the interior of the central hub of the spray apparatus shown in FIG. 2.
Figure 5:
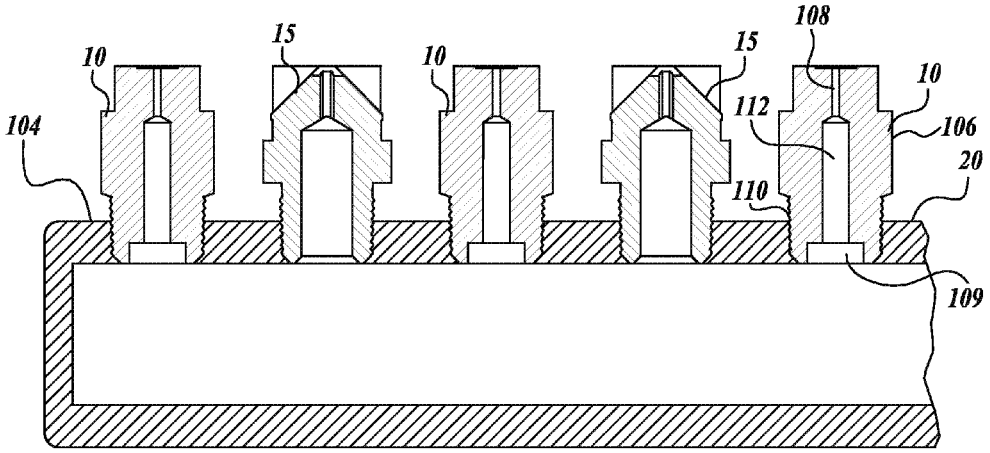
FIG. 5 illustrates a partial cross-sectional view of an arm of the spray apparatus shown in FIG. 2.
Figure 6:
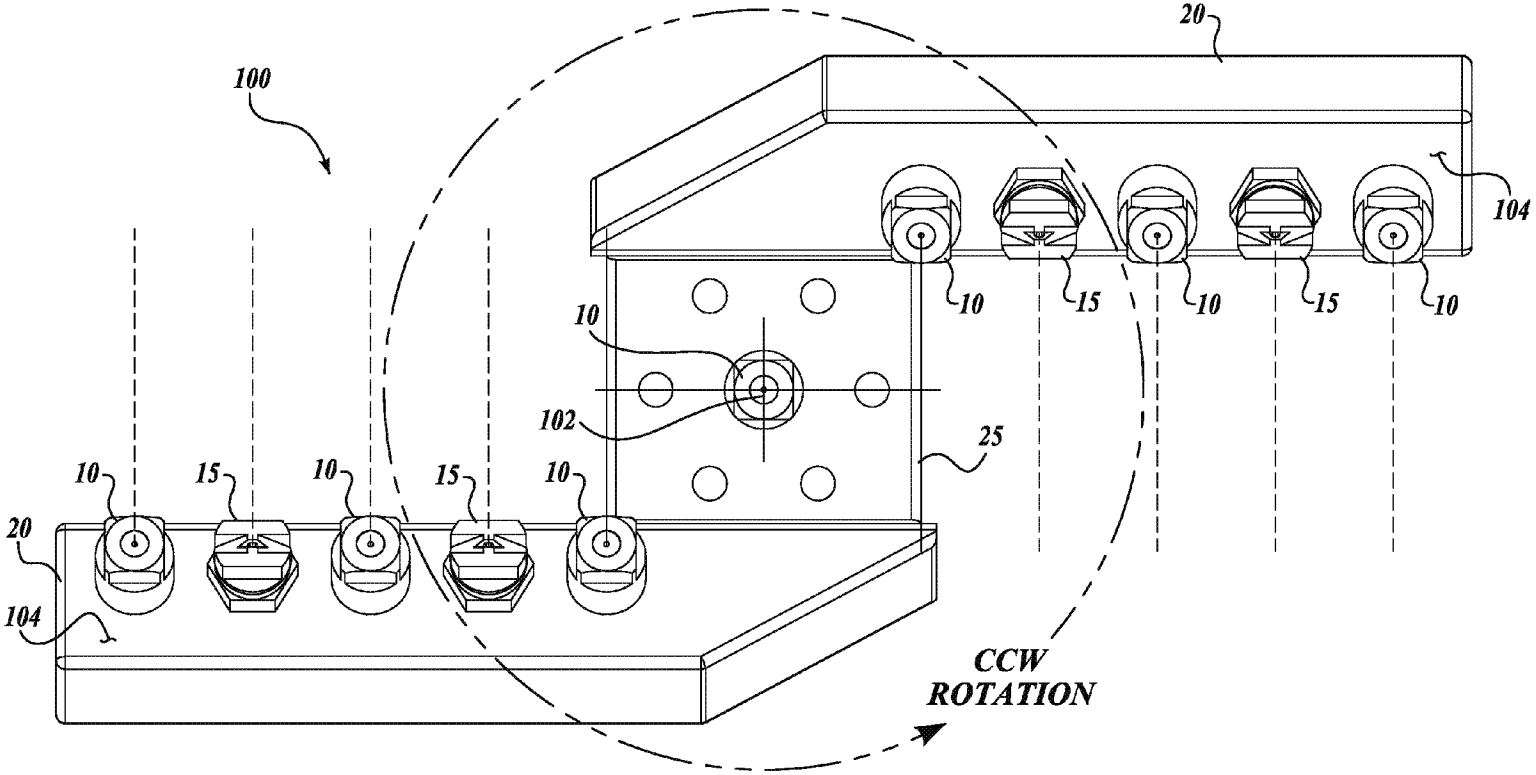
FIG. 6 illustrates a view axial to the rotation of the spray apparatus shown in FIG. 2 indicating the direction of rotation of the spray apparatus and spray emanating from the nozzles.

The spray nozzles 10 and 15 are shown as canted relative to the rotational axis 102 of the spray bar 100. As shown in FIG. 4, the spray nozzles 10 and 15 may be canted relative to the rotational axis of the spray bar 100 at an angle $\alpha$. In one embodiment, the angle $\alpha$ may be in the range from about 22° to about 25°.

The spray apparatus 100 of the present invention may be used to remove residual mucilaginous embryonal suspensor mass from developed cotyledonary embryos. The spray nozzles 10 and 15 may be either configured or positioned along the stray bar to cooperatively provide substantially uniform spray coverage during rotation of the spray bar. The spray nozzles 10 and 15 may perform different functions during the separation process. Spray nozzles 10, which discharge liquid in the form of a cone-shaped spray pattern, produce a gentle spray and cover a wide area. Spray nozzles 15, which discharge liquid in the form of a fan-shaped spray pattern, are particularly effective in removing the ESM from the embryos.

In addition to removal of the underlying ESM from the embryos, during the separation process, the embryos may be separated from each other into discrete embryo units and sorted according to size. For example, the embryos may be washed off from a development medium using aqueous liquid and disposed onto a porous material. The substrate upon which plant embryos are disposed may be a sieve or series of sieves. The sieve(s) may be circular.

During sieving, the embryos may be further sprayed with aqueous liquid to facilitate removal and washing away of any undesirable material, such as undersized embryos, tissues, and residual embryonal suspensor masses (ESM), through the holes of the sieves. In some embodiments, more than one sieve may be used to separate the embryos from the ESM and to sort the embryos according to size. The mesh opening sizes of the sieve(s) are selected so as to capture the desired sized embryos. The sieves may be arranged in a stack such that a first sieve with a first mesh opening size is placed on top of a second sieve with a second mesh opening size that is smaller than the first mesh opening size. By way of example, the first sieve may be of a mesh opening size such that embryos of the desired size, undersized embryos, and the embryonal suspensor mass pass through the first sieve, and embryos that are larger than the desired size are captured on the surface of the first sieve. The second sieve may be of a mesh opening size such that embryos of the desired size are captured on the second sieve, and undersized embryos and the embryonal suspensor mass pass through the second sieve.

The sieving process may occur in a series of steps in which (i) the embryos and attached ESM are removed from development medium and disposed on the surface of a first sieve; (ii) the embryos and ESM are sprayed with an aqueous liquid using the spray apparatus of the invention; (iii) over-sized embryos are captured on the surface of the first sieve, and embryos smaller in size than the first mesh opening size and ESM pass through the first sieve; (iv) the first sieve, containing oversized embryos, is removed from the stack of sieves; (v) the embryos and ESM disposed on the surface of the second sieve are again sprayed with aqueous liquid using the spray apparatus of the invention; (vi) embryos of the desired size are captured on the surface of the second sieve; and (vii) undersized embryos and ESM pass through the second sieve. Thus, only those embryos of generally desired size/shape, which are more or less free of suspensor tissue and other fine plant material, remain on the second sieve. By adjusting the mesh opening size/shape of the one or more sieves, only those embryos within a desirable size/shape range are selected, resulting in a population comprising mostly embryos separated from each other and substantially free of suspensor tissues.

In some embodiments, more than two sieves may be used, each sieve having a different mesh opening size from the mesh opening size of each of the other sieves to further sort the embryos according to size/shape. For example, in one embodiment three sieves may be used. In one embodiment four sieves may be used. The mesh opening sizes may vary in the range from about 850 microns to about 2400 microns. For example, mesh opening sizes of 850, 1000, 1180, 1400, 1700, 2000, and 2400 microns may be used. In one embodiment, the first sieve has a mesh opening size of about 2400 microns. In one embodiment, the second sieve has a mesh opening size of about 1400 microns.

The spray apparatus of the invention is designed to facilitate the sieving process. It is desirable that the spray bar is configured such that the plant embryos and ESM disposed on the sieve(s) are contacted for substantially the same amount of time by the spray jets at every radius inside the radius of the sieve(s).

In one embodiment, the drive system rotates the spray bar 100 in a direction opposite to the direction that the spray nozzles 10 and 15 are canted such that the spray nozzles 10 and 15 provide both a downward and tangential force on the plant embryos disposed on a sieve. The downward force pushes the embryos through the openings of the sieves. The tangential force moves the ESM and the embryos across the sieve. As the mesh of the sieve is uneven, the tangential force causes the plant embryos to wiggle, and when they randomly orient in a vertical position, they present their slender profile to the mesh opening, thus allowing them to pass through the sieve if they have the proper diameter. Without random wiggles, many of the embryos remain flat, and thus only expose their long axis to the mesh openings, and are less likely to pass through.

When the spray bar rotates in the same direction that the spray nozzles 10 and 15 are canted, the spray jets typically simply push the embryos in circles around the mesh sieve. The embryos then move at a speed that typically doesn't give them the time to orient in such a way as to pass through the openings, thus reducing the effectiveness of the sieving operation.

The spray nozzles 10 and 15 may be selected to have various liquid delivery rates. For example, in one embodiment, the spray nozzles 10, which discharge a cone-shaped spray pattern, have a rating of 0.10 gpm (gallons per minute) at a pressure of 10 psi (pounds per square inch). In one embodiment, the spray nozzles 15, which discharge a fan-shaped spray pattern, have a rating of 0.25 gpm at a pressure of 10 psi.

The rotational speed of the spray bar and the number of rotations may be varied to achieve optimal separation and efficiency. If the rotational speed is too fast, the spray jets do not cut through the ESM holding the plant embryos together. If the rotational speed is too slow, then the separation process takes more time, and the production rate is reduced. Generally, slower rotational speeds and more rotations are used for sieves of smaller opening sizes. In some embodiments, rotational speeds, in revolutions per minute (RPM), may be in the range from about 0.75 RPM to about 2 RPM. For example, when the mesh opening size is in the range from about 1700 microns to about 2400 microns, a rotational speed of 2.0 RPM may be used. When the mesh opening size is in the range from about 850 microns to about 1400 microns, a rotational speed of about 0.75 RPM may be used.

The spray apparatus further comprises a housing 200 within which the spray bar 100 is positioned. An exemplary embodiment of the housing 200 is shown in FIG. 1. The housing 200 may further comprise a hollow drive shaft (not shown) which is in fluid flow communication with the central hub 25 and in fluid flow communication with a liquid supply. The drive shaft also supports and powers the spray apparatus. Liquid may be supplied to the spray apparatus 100 through sealed conduits (not shown) within the housing 200. The housing 200 may be designed to surround the spray bar 100 and to contain aerosols generated from the liquid spray emanating from the spray nozzles 10 and 15. In one embodiment, the housing 200 is of a shape and size such that, during the spray separation process, the housing 200 engages around the substrate upon which the embryos are disposed to form a seal, thus creating a closed spray system and reducing the spread of any contamination that may be present in the spray aerosols.

The housing 200 may further include a vent (not shown) communicating between the interior of the housing and the exterior of the housing, wherein air displaced by the spray emanating from the spray nozzles is directed to the atmosphere outside of the closed spray system through the vent.

As described herein, according to the invention, a spray apparatus is provided to automatically remove residual mucilaginous embryonal suspensor mass from developed cotyledonary plant embryos and to separate the cotyledonary plant embryos from each other. The spray apparatus of the invention may be used in conjunction with a series of sieves to sort the cotyledonary plant embryos according to a desired size.

In one aspect, the present invention provides methods for separating plant embryos from embryogenic suspensor mass. The methods of the invention include the steps of: (a) depositing a plurality of plant embryos attached to embryogenic suspensor mass onto a porous substrate; (b) spraying the plant embryos and embryogenic suspensor mass with a liquid discharged from a spray apparatus comprising a plurality of spray nozzles, wherein the spray nozzles are configured to discharge spray patterns designed to push the plant embryos through the porous substrate and also move the embryos across the surface of the porous substrate.

In one embodiment, the liquid discharged from the spray apparatus provides substantially uniform spray coverage of the porous substrate upon which the plant embryos and embryogenic suspensor mass are disposed.

In one embodiment, the spray nozzles are selected from the group consisting of nozzles that discharge a cone shaped-spray pattern, a fan-shaped spray pattern, an oval-shaped spray pattern, and combinations thereof. In one embodiment, all the spray nozzles are nozzles that discharge a cone-shaped spray pattern. In one embodiment, all the spray nozzles are nozzles that discharge a fan-shaped spray pattern. In one embodiment, the spray nozzles are a combination of nozzles that discharge a cone-shaped spray pattern and nozzles that discharges a fan-shaped spray pattern.

In one embodiment, the spray apparatus comprises (i) a spray bar; (ii) one or more arms extending outwardly from a rotational axis of the spray bar; and (iii) a plurality of spray nozzles mounted on the spray apparatus. In one embodiment, the spray nozzles are canted relative to the rotational axis of the spray bar.

In one embodiment, step (b) of the methods of the invention is performed by rotating the spray bar in a direction opposite to the direction the spray nozzles are canted.

Plant embryos suitable for use in the methods of the invention may be from any plant species, such as dicotyledonous or monocotyledonous plants, gymnosperms, etc. Conifer embryos are suitable for use in the methods of the invention and may be from any conifer species including, but not limited to, species within the genera Pinus, Picea, Tsuga, Pseudotsuga, Thuja, Juniperis, Larix, and Sequoia.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A method of separating plant embryos from embryogenic suspensor mass comprising the steps of:

(a) depositing a plurality of plant embryos attached to embryogenic suspensor mass onto a porous substrate;

(b) spraying the plant embryos and embryogenic suspensor mass with a liquid discharged from a spray apparatus comprising a plurality of spray nozzles, wherein the spray nozzles are configured to discharge spray patterns designed to push the plant embryos through the porous substrate and also move the embryos across the surface of the porous substrate.

2. The method of separating plant embryos according to claim 1, wherein the liquid discharged from the spray apparatus provides substantially uniform spray coverage of the porous substrate upon which the plant embryos and embryogenic suspensor mass are disposed.

3. The method of separating plant embryos according to claim 1, wherein the spray nozzles are selected from the group consisting of nozzles that discharge a cone shaped-spray pattern, a fan-shaped spray pattern, an oval-shaped pray pattern, and combinations thereof.

4. The method of separating plant embryos according to claim 3, wherein the spray nozzles are a combination of nozzles that discharge a cone-shaped spray pattern and nozzles that discharges a fan-shaped spray pattern.

5. The method of separating plant embryos according to claim 1, wherein the spray apparatus comprises: (i) a spray bar; (ii) one or more arms extending outwardly from a rotational axis of the spray bar; and (iii) a plurality of spray nozzles mounted on the spray apparatus, wherein the spray nozzles are canted relative to the rotational axis of the spray bar.

6. The method of separating plant embryos according to claim 5 wherein step (b) is performed by rotating the spray bar in a direction opposite to the direction the spray nozzles are canted.

* * * * *